US005293812A

United States Patent [19]

Maki et al.

[11] Patent Number: 5,293,812

[45] Date of Patent: Mar. 15, 1994

[54] BRAKING APPARATUS FOR CYLINDER

[75] Inventors: Daiju Maki, Aichi; Kazutoshi Ito, Komaki; Kenji Matsuo, Gifu; Junji Mutsuura, Konan, all of Japan

[73] Assignee: CKD Corporation, Aichi, Japan

[21] Appl. No.: 972,497

[22] PCT Filed: Oct. 31, 1991

[86] PCT No.: PCT/JP91/01484

§ 371 Date: Feb. 5, 1993

§ 102(e) Date: Feb. 5, 1993

[87] PCT Pub. No.: WO92/08057

PCT Pub. Date: May 14, 1992

[30] Foreign Application Priority Data

Nov. 1, 1990 [JP] Japan ..... 2-297875

[51] Int. Cl.[5] ..... F15B 15/14; F15B 15/26

[52] U.S. Cl. ..... 92/27; 92/88

[58] Field of Search ..... 188/28, 33, 41, 43, 188/45, 56, 82.1, 82.3, 106 F, 107, 153 R, 67, 72.9; 92/88, 15, 18, 23, 27

[56] References Cited

U.S. PATENT DOCUMENTS 3,407,598 10/1968 Yokota ..... 92/15 X
4,926,982 5/1990 Granbom ..... 92/88 X
4,981,069 1/1991 Matsui ..... 92/15 X
5,022,499 6/1991 Lundqvist ..... 92/88 X

FOREIGN PATENT DOCUMENTS 61-252908 11/1986 Japan .
62-67310 3/1987 Japan .
63-176804 7/1988 Japan .
63-190907 8/1988 Japan ..... 92/88
64-45008 3/1989 Japan .
1-295009 11/1989 Japan .

*Primary Examiner*—Robert J. Oberleitner
*Assistant Examiner*—Peter M. Poon
*Attorney, Agent, or Firm*—Hickman & Beyer

[57] ABSTRACT

Disclosed is a braking apparatus for a rod-less cylinder. A transfer member (3) arranged outside a cylinder body (1) is coupled to a piston (2) disposed movably within the cylinder body (1), and moves together with the piston (2). A brake rail (8) is arranged on the outer side surface of the cylinder body (1), extending in parallel to the moving direction of the piston (2). A braking member (16) faces the brake rail (8) in such a manner as to be engageable therewith, and disengageable therefrom, and is moved to a contact position where it engages the brake rail (8), and a release position where it disengages from the brake rail (8) by an operation member (17), to accomplish the braking and unbraking of the transfer member (3).

12 Claims, 12 Drawing Sheets

BRAKING APPARATUS FOR CYLINDER

TECHNICAL FIELD

The present invention relates to a braking apparatus for stopping a transfer body, which moves with as a piston in a rod-less cylinder, at a predetermined position.

BACKGROUND ART

Some rod-less cylinders are designed so that a transfer body moves along the cylinder with the movement of a piston in the cylinder, and are equipped with a braking apparatus in order to brake and stop the transfer body at a predetermined position.

The structure of such a braking apparatus for cylinder is disclosed in, for example, Japanese Unexamined Patent Publication No. 63-176804. In this apparatus, a brake rod is rotatably supported outside the cylinder body, and extends in parallel to the moving direction of the piston. Means for rotating the brake rod is provided at one end of the cylinder body. An eccentric cam is rotatably supported on the transfer body, with its outer periphery in contact with a needle bearing or the like. This eccentric cam is provided with a cam hole to allow the brake rod to be inserted slidably, but only along the axial direction.

When the brake rod is rotated by a brake-rod rocking means, the eccentric cam rotates eccentrically. This causes a wedge effect between the eccentric cam and the needle bearing or the like, so that the cam hole of the eccentric cam is pressed against the brake rod, by the force acting in a direction orthogonal to the axial direction, thus braking and stopping the transfer body at a predetermined position.

This conventional apparatus, however, requires that a support mechanism for rotatably supporting both ends of the brake rod should be provided outside the cylinder body. This enlarges the apparatus as a whole, and complicates its structure.

In addition, the apparatus is designed so that the eccentric cam rotates by the rotation of the brake rod, to apply braking. Therefore, the traveling stroke of the transfer body is restricted by the torsional rigidity of the brake rod. Further, the torsional amount of the brake rod varies with a change in the position of the moved transfer body, so that the braking force varies accordingly.

It is therefore an object of the present invention to provide a braking apparatus for a cylinder, which can simplify its structure to downsize the apparatus as a whole.

It is another object of the present invention to provide a braking apparatus for cylinder, which can secure a large traveling stroke for a transfer body, and which can always stop the transfer body with constant braking force, regardless of a change in the position of the transfer body.

DISCLOSURE OF THE INVENTION

A braking apparatus for a cylinder according to this invention comprises a piston placed movably in a cylinder body, a transfer member arranged outside the cylinder body and coupled to, and movable with the piston, and a brake rail arranged on an outer side surface of the cylinder body, to extend in parallel to the moving direction of the piston. The apparatus further comprises a braking member, facing the brake rail in such a manner as to be engageable therewith and disengageable therefrom, and movable to a contact position, where it engages with the brake rail and to a release position, where it disengages from the brake rail, to brake and release the transfer member, and an operation device for operating the braking member to the contact position and the release position.

With the transfer member moved to a predetermined position by the movement of the piston, when the braking member is shifted to the contact position from the release position by the operation device, the braking member engages the brake rail, so that the transfer member is stopped firmly at the predetermined position. The traveling stroke of the transfer member is therefore not restricted at all by the traveling stroke of a moving device, so that the transfer member can have a large traveling stroke. Further, the transfer member can always be stopped with a constant braking force, regardless of a change in the position of the transfer member.

BEST MODES OF CARRYING OUT THE INVENTION

A rod-less cylinder according to a first embodiment of the present invention will now be described in detail, referring to FIGS. 1 through 5.

Figure 1:
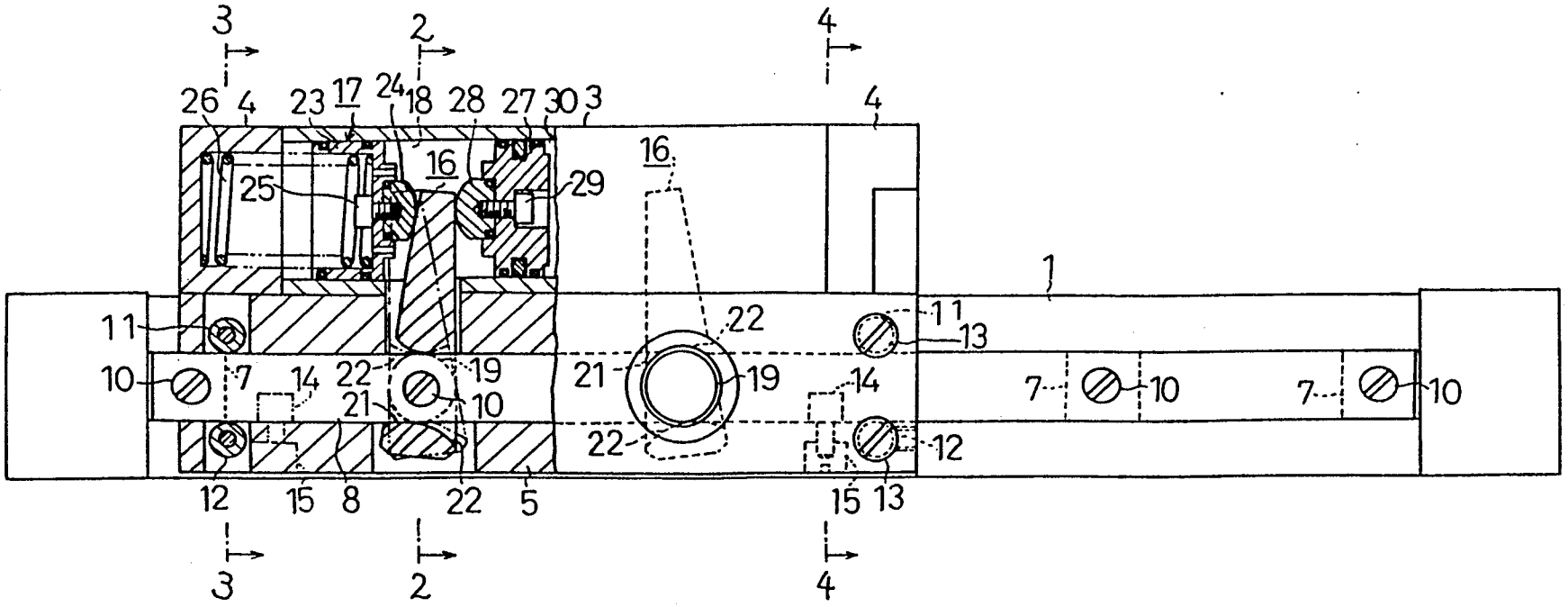
FIG. 1 is a partly cutaway front view illustrating a rod-less cylinder according to a first embodiment of the present invention.
Figure 2:
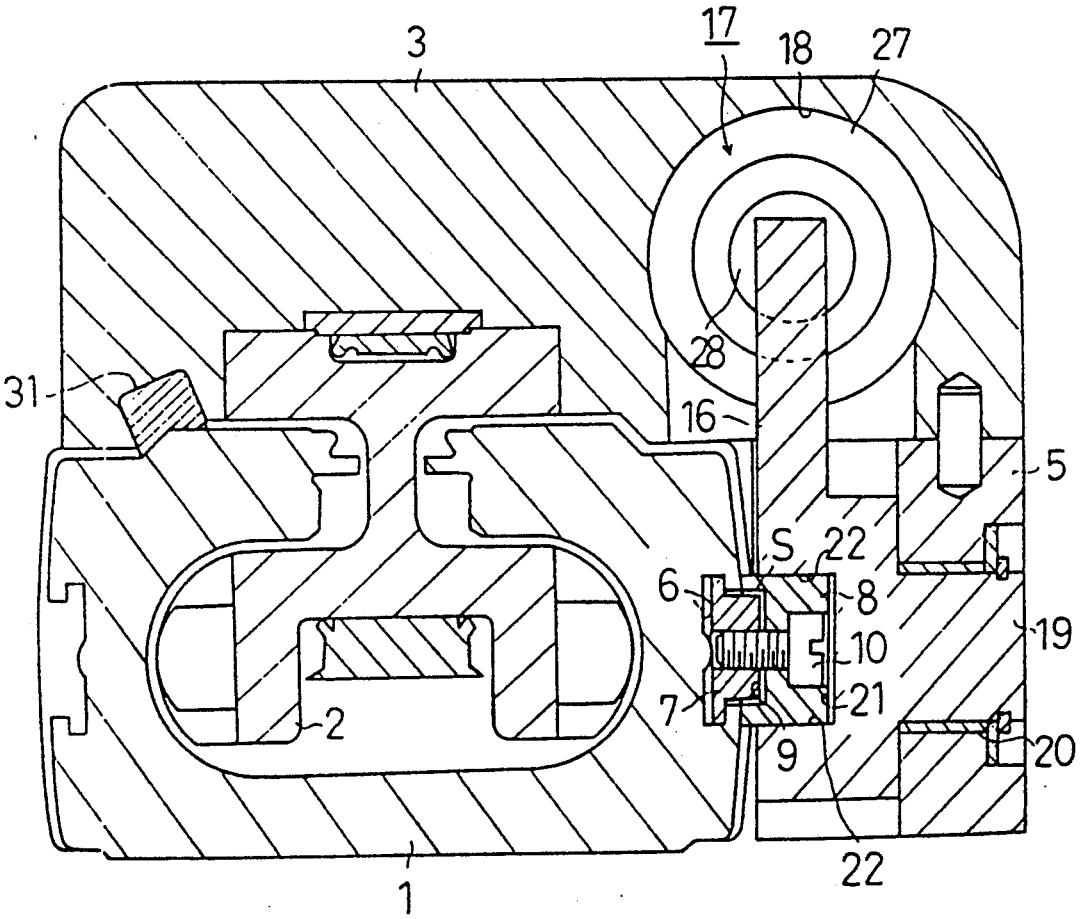
FIG. 2 is an enlarged cross sectional view taken along the line A—A in FIG. 1.

As shown in FIGS. 1 and 2, a piston 2 is movably accommodated within a cylinder body 1 having a cylindrical form. A transfer table 3 is secured to the outer side edge of the piston 2, and moves along the cylinder body 1, with the piston 2. End plates 4 are attached to both ends of the table 3, along the direction of movement. A support block 5 is secured to the bottom of the transfer table 3, and extends adjacent and in parallel to one outer surface of the cylinder body 1.

Dovetail grooves 6 are formed on both side surfaces of the cylinder body 1, and extend in parallel to the moving direction of the piston 2. A plurality of internally threaded parts 7 are received movably in one of the dovetail grooves 6, which faces the support block 5. Part of each threaded part 7 protrudes from that dovetail groove 6 outwardly from the cylinder body 1. A brake rail 8, is made of iron, and is laid on the outer side surface of the cylinder body 1, corresponding to the dovetail groove 6. Recesses 9 are formed on the inner surface of the brake rail 8. Each of the recesses 9 is engageable with the projection of the internally threaded part 7.

A plurality of screws 10 are engaged with the internally threaded parts 7 from the outer surface of the brake rail 8. The brake rail 8 is securely coupled to the outer side surface of the cylinder body 1 by fastening these screws 10. As shown in FIG. 2, there is a clearance (S) between each recess 9 of the brake rail 8 and the projection of the internally threaded part 7. At the time of fastening the screws 10, the brake rail 8 can be adjustably moved up or down within the range of the clearance (S) to make centering adjustment, such that the brake rail 8 extends in parallel to the moving direction of the piston 2, before the rail 8 is secured to the cylinder body 1.

Figure 3:
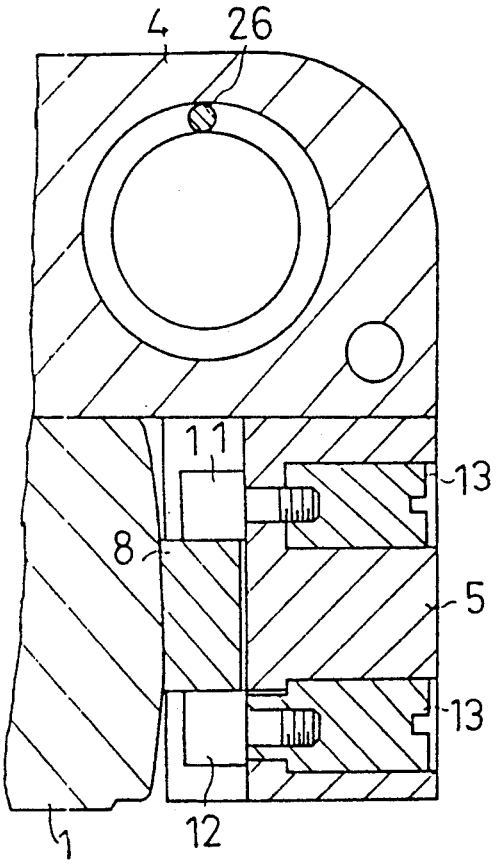
FIG. 3 is an enlarged cross sectional view taken along the line B—B in FIG. 1.
Figure 4:
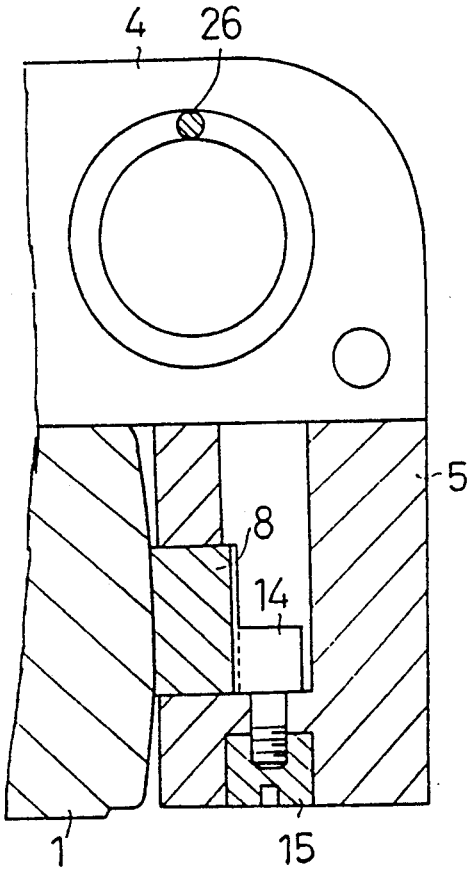
FIG. 4 is an enlarged cross sectional view taken along the line C—C in FIG. 1.

As shown in FIGS. 1 and 3, plural pairs of first guide rollers 11 and 12 are each supported on both ends of the inner wall of the support block 5 to be rotatable around the horizontal axis. When the first guide rollers 11 and 12 rotate in engagement with the top and bottom surfaces of the brake rail 8, the up-and-down movement of the table 3 is restricted. As shown in FIGS. 1 and 4, two second guide rollers 14 are supported by roller holders 15 on both ends of the support block 5 to be rotatable around the vertical axis. As the second guide rollers 14 rotate in contact with the outer surface of the brake rail 8, the sideways movement of the table 3 is restricted.

A guide shoe 31 is fitted in the left bottom surface of the table 3, as shown in FIG. 2. The bottom surface of the guide shoe 31 is slid and guided along a protruding portion integrally formed on the top surface of the cylinder body 1.

As shown in FIGS. 1 and 2, two sets of braking levers 16 and operation devices 17 therefor, are provided on the table 3 and the support block 5, symmetrically across the center position of the table 3, along the direction of movement.

The structure of one of the two sets will be described below. A cylinder chamber 18 is formed within the table 3, and extends in parallel to the direction of movement of the piston 2. The braking lever 16 is rotatably supported around the horizontal axis, on the inner wall of the support block 5, by a bearing sleeve 20, at a pivot portion 19. The upper end of the lever 16 protrudes into the cylinder chamber 18. A recess 21 is formed on the inner wall of the braking lever 16, and has arcuate braking surfaces 22 on its top and bottom surfaces, which protrude in such a direction as to be engageable with, and disengageable from the brake rail 8. The braking surfaces 22 are plated with copper so that they wear out less, even when being in contact with the iron brake rail 8.

Figure 5:
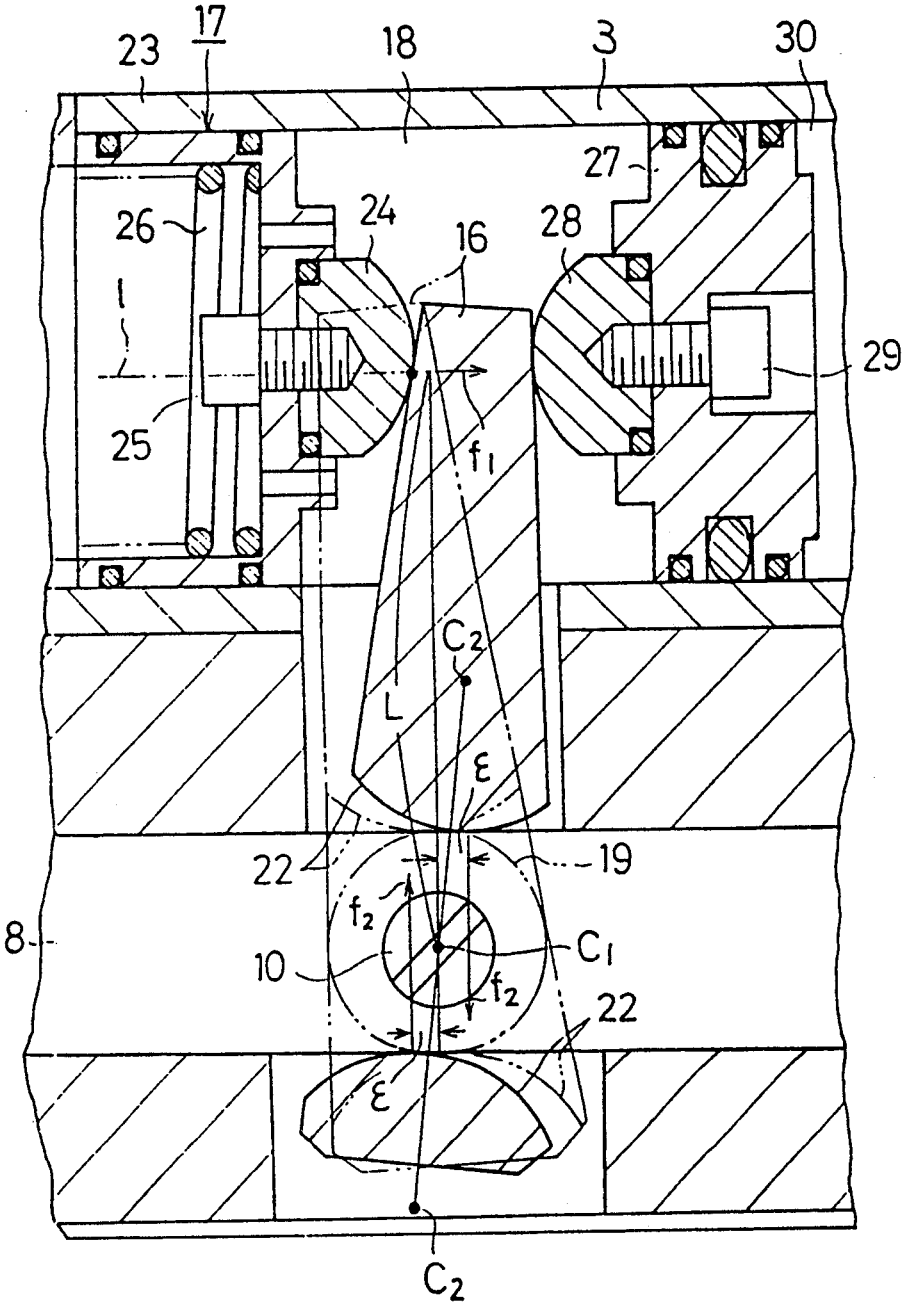
FIG. 5 is an enlarged cross sectional view showing the action of generating brake force.

When the braking lever 16 is held at a contact position indicated by the solid line in FIGS. 1 and 5, the braking surfaces 22 are pressed against the top and bottom surfaces of the brake rail 8, thus applying a braking force to the table 3. When the braking lever 16 is rotated to a release position indicated by the chain line in the figures, the braking surfaces 22 disengage from the top and bottom surfaces of the brake rail 8, thus releasing the braking force on the table 3.

A piston 23 for braking is movably placed at a side end portion in the cylinder chamber 18. A first engaging member 24 is secured to one end surface of the piston 23 by means of a screw 25. The first engaging member 24 engages the braking lever 16 from the side. A spring 26 is provided between the piston 23 and the end plate 4. This spring 26 urges the piston 23 toward the center so that the braking lever 16 is usually placed at the contact position indicated by the solid line in FIGS. 1 and 5.

A piston 27 for releasing is movably placed at the center portion in the cylinder chamber 18. A second engaging member 28 is secured to one end surface of the piston 27 by means of a screw 29. The second engaging member 28 engages the braking lever 16 from the side. When fluid, such as air, is supplied into a central space 30 in the cylinder chamber 18 from a port (not shown), the releasing piston 27 moves outwardly, against the force of the spring 26, thus rotating the braking lever 16 to the release position, indicated by the chain line in FIGS. 1 and 5.

The operation of the foregoing braking apparatus for the cylinder will now be described.

Normally, the braking lever 16 is held at the contact position, via the braking piston 23 by the urging force of the spring 26, as indicated by the solid line in FIGS. 1 and 5. The braking surfaces 22 of the braking lever 16 are pressed against the top and bottom surfaces of the brake rail 8, so that the table 3 is held at the stoppage position. Under this condition, when a fluid, such as air, is supplied, into the central space 30 in the cylinder chamber, 18 from the port (not shown), the releasing piston 27 moves outward against the force of the spring 26. Then, the braking lever 16 rotates to the release position indicated by the chain line in FIGS. 1 and 5. As a result, the braking surfaces 22 become disengaged from the top and bottom surfaces of the brake rail 8, thus releasing the braking force on the table 3.

When the piston 2 in the cylinder body 1 is activated, the table 3 moves along the cylinder body 1. When the supply of the fluid, such as air, to the central space 30 in the cylinder chamber 18 is stopped, at the time the table 3 has moved to a predetermined position, the braking lever 16 is rotated to the contact position from the release position, via the braking piston 23, under the urging force of the spring 26. Consequently, the braking surfaces 22 are pressed against the top and bottom surfaces of the brake rail 8, and cause the table 3 to stop at the predetermined position.

Given that the rotational center of the braking lever 16 is C1, the axis representing the direction of the abutting action of the first engaging member 24 to the braking lever 16 is l. The distance between the rotational center C1 and the axis l is L; and the center of the radius of the arcuate braking surface 22 is C2. The distance between the center of the radius C2 and the rotational center C1 along the lengthwise direction of the brake rail 8 under the braking condition is $\epsilon$; the load of the spring 26 is f1; and the pressing force of the braking lever 16 on the brake rail 8 via only one of the braking surfaces 22 is f2. As shown in FIG. 5, the pressing force f2 is expressed by the following equation (1):

$$f2 = \frac{1}{2} \cdot f1 \cdot L/\epsilon \quad (1)$$

Given that the friction coefficient between the braking surface 22 and the brake rail 8 is $\mu$, the braking force f3 by a single braking lever 16 is expressed by the following equation (2):

$$\begin{aligned} f3 &= 2 \cdot f2 \cdot \mu \\ &= f1 \cdot \mu \cdot L/\epsilon \end{aligned} \quad (2)$$

It is apparent from equation (2) that when the distance $\epsilon$ is considerably smaller than the distance L, the braking force f3 will be significantly greater than the load f1.

In the braking apparatus according to this embodiment, the brake rail 8 is secured to the outer side surface of the cylinder body 1 as described above. Therefore, unlike conventional designs, it is unnecessary to provide a support mechanism for rotatably supporting both end portions of a long brake rod. The structure can thus be simplified to downsize the overall apparatus.

In the braking apparatus according to this embodiment, the braking lever 16 supported on the table 3 is rotated to the contact position and the release position by the operation device 17, to engage, or disengage from the brake rail 8. Unlike conventional braking apparatus, the traveling stroke of the table 3 will not be restricted by the torsional rigidity of the brake rod. Furthermore, the braking force will not vary with variations in the position of the table 3. It is therefore possible to secure a large traveling stroke for the table 3, and to always stop the table 3 at a predetermined position with a constant braking force.

Further, the braking lever 16 is not coupled directly to the braking piston 23, and the releasing piston 27, but is in contact and engagement with them, via the first and second engaging members 24 and 28, in the braking apparatus of this embodiment. When the braking lever 16 is rotated to the contact position from the release position, to stop the table 3, the impact originated by the braking will not be transferred via the braking lever 16 to the cylinder body 1.

A second embodiment of the present invention will now be described referring to FIGS. 6 through 9.

Figure 6:
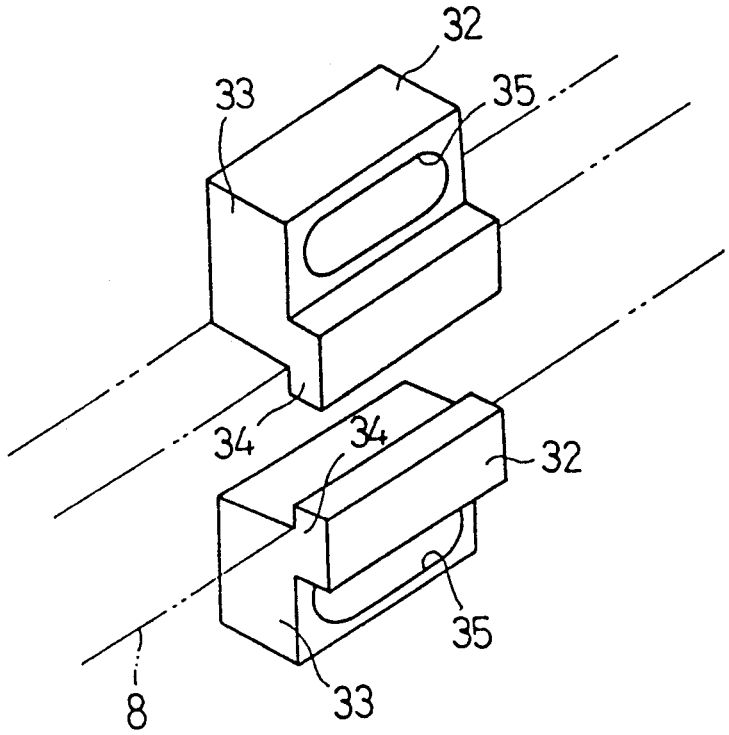
FIG. 6 is a perspective view showing a brake shoe according to a second embodiment of the present invention.

According to this embodiment, a pair of upper and lower copper followers 32, as shown in FIG. 6, are attached to those portions of the braking lever 16 where the lever 16 comes into contact with the brake rail. Each of these followers 32 comprises a thick-walled body portion 33, and an angled contact portion 34 formed on that surface of the body portion 33, facing the other body portion 33. An elongated cavity 35 is formed in the body portion 33.

Figure 7:
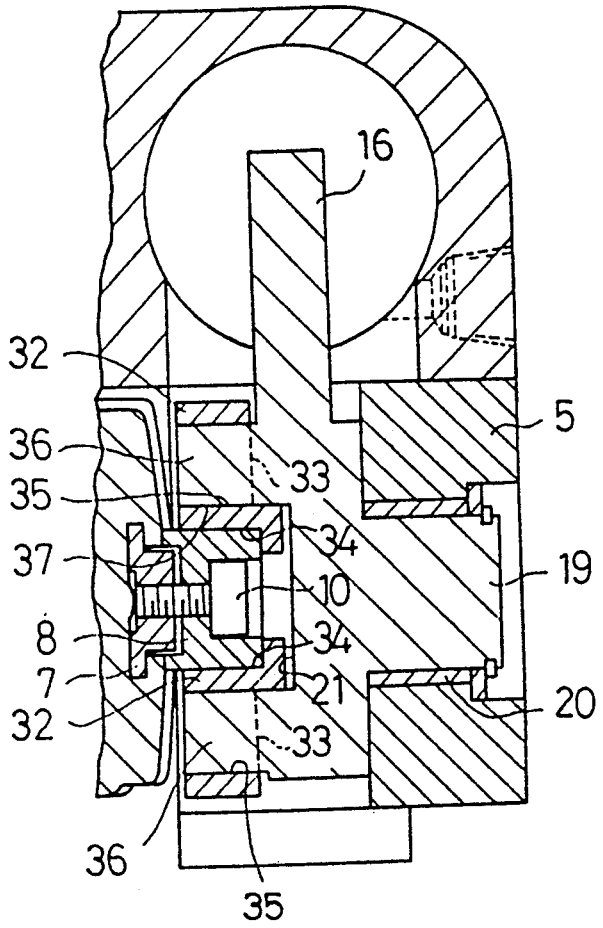
FIG. 7 is a partly cutaway cross-sectional side view illustrating the use of the brake shoe in FIG. 6.
Figure 8:
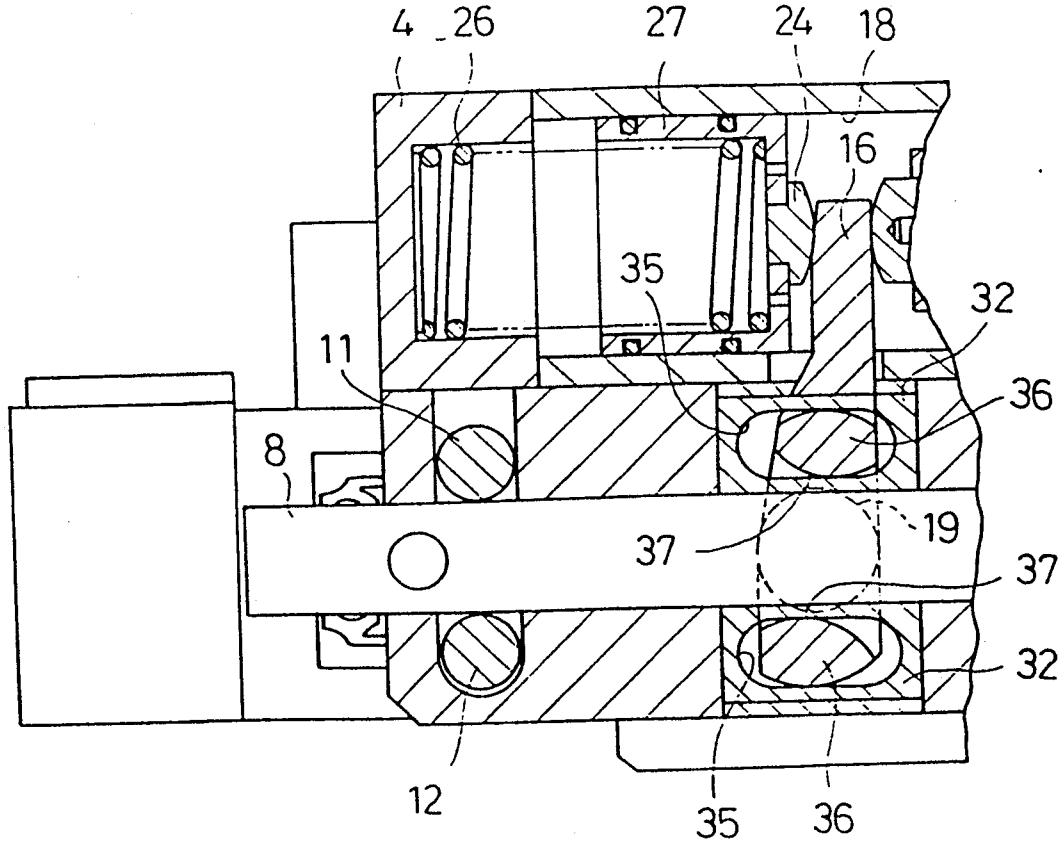
FIG. 8 is a partly cutaway cross-sectional front view also illustrating the use of the brake shoe in FIG. 6.

As shown in FIGS. 7 and 8, the braking lever 16 is provided with a pair of upper and lower engaging projections 36. The opposing surfaces of the engaging projections 36 serve as braking surfaces 37. As the engaging projections 36 are fitted in the cavities 35, the followers 32 are attached to the braking lever 16.

With the above structure, when the braking lever 16 is at the contact position, the braking surface 37 presses the inner edge of the cavity 35 of the associated follower 32 toward the iron brake rail 8. This force deforms the railside portions of both followers 32. The end faces of both the contact portions 34 are thus pressed against the brake rail 8, for holding the table 3 at the stop position.

When the braking lever 16 is rotated to the release position, the contact of the followers 32 to the brake rail 8 is released. This releases the braking on the table 3, and causes the table 3 to start moving.

As mentioned above, the braking lever 16 does not come into direct contact with the brake rail 8 in this embodiment. As braking action is applied, the followers 32 having flat surfaces, in place of the curved braking surfaces 37 of the braking lever 16, are pressed against the brake rail 8. The damage to the brake rail 8 will thus be reduced. This allows the brake rail 8 and followers 32 to have lower material strengths, thus achieving cost reduction of the individual components.

The braking lever 16 will not directly contact the brake rail 8, so that the braking lever 16 will not be applied with high impact upon braking. Even if this cylinder were not used for a long period of time, it is less likely that the braking lever 16 should be replaced due to such reasons as damage or breakage, but only the followers 32, which are lower in cost, need to be replaced.

In addition, as the follower 32 and the brake rail 8 are made of different materials, the friction therebetween becomes smaller and reduces wear.

Figure 9:
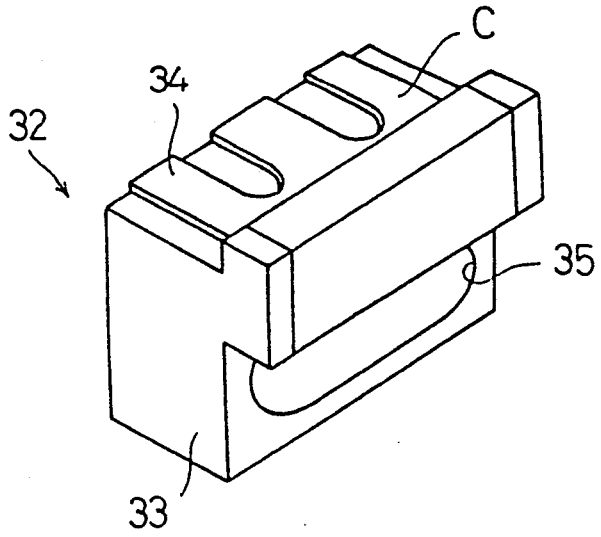
FIG. 9 is a perspective view showing a modification of the brake shoe according to the second embodiment.

FIG. 9 illustrates a modification of this embodiment. In this modification, while the followers 32 are made of iron, a copper plate (C) is attached to the whole contact portion 34 except both side edge portions. With this structure too, since the brake rail 8 and the contact portion 34 of the follower 32 are made of different materials, the wear between them is avoided.

In this structure, copper may be plated or spray-coated on the contact portion 34.

A third embodiment of the present invention will now be described referring to FIGS. 10 and 11.

Figure 10:
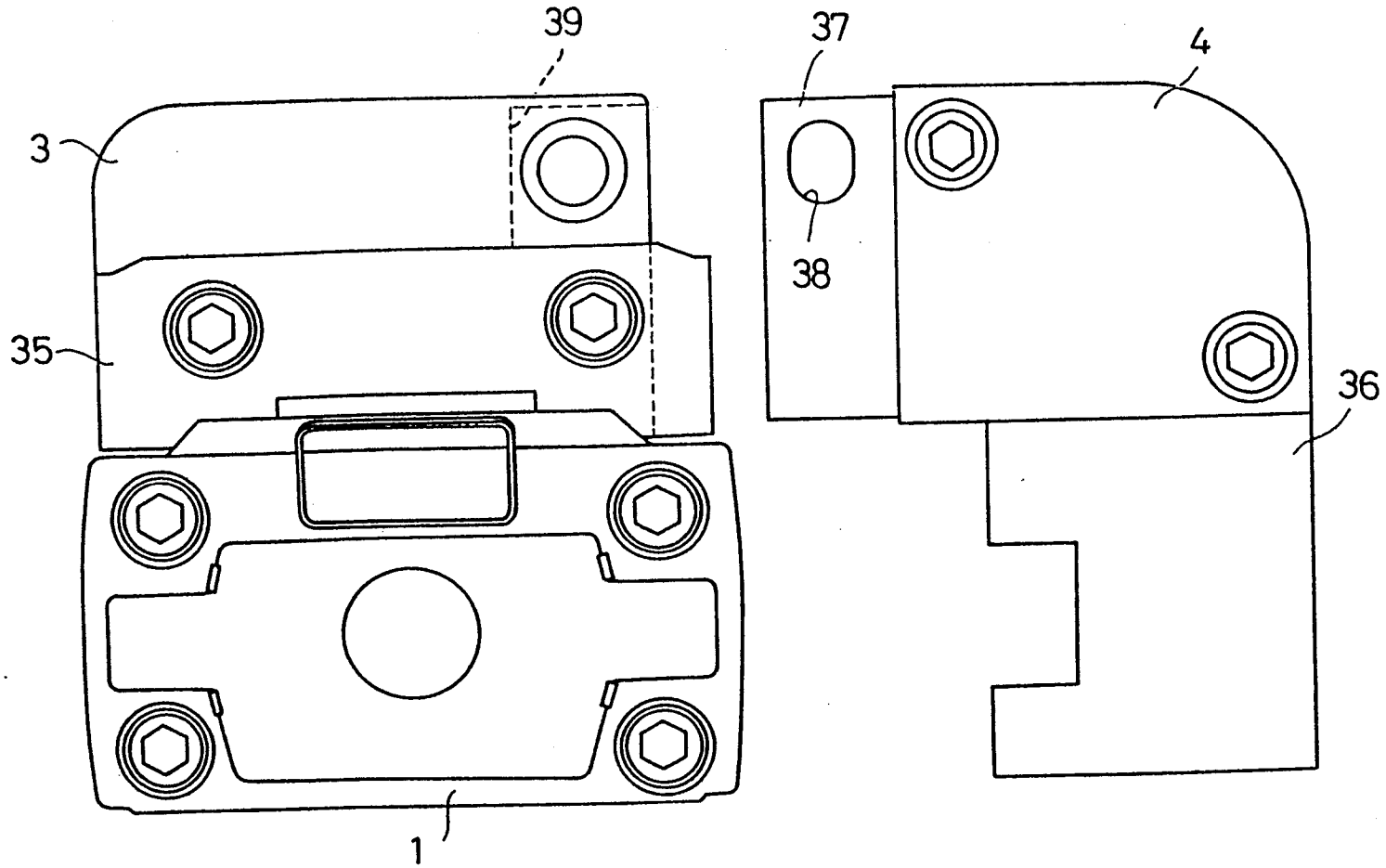
FIG. 10 is a front view showing a rod-less cylinder according to a third embodiment of the present invention.

According to this embodiment, the cylinder apparatus is designed to be separable into a moving mechanism 35 for moving the transfer table 3 and a braking mechanism 36 for braking the table 3, as shown in FIG. 10.

A bore 38 is formed in an attachment arm 37 protruding from the end plate 4 of the braking mechanism 36. A fitting recess 39 corresponding to the attachment arm 37 is formed in the end portion of the table 3. A bore 40 and a threaded bore 41 are formed on the left- and right-hand sides of the recess 39 at the end portion of the moving mechanism 35.

Figure 11:
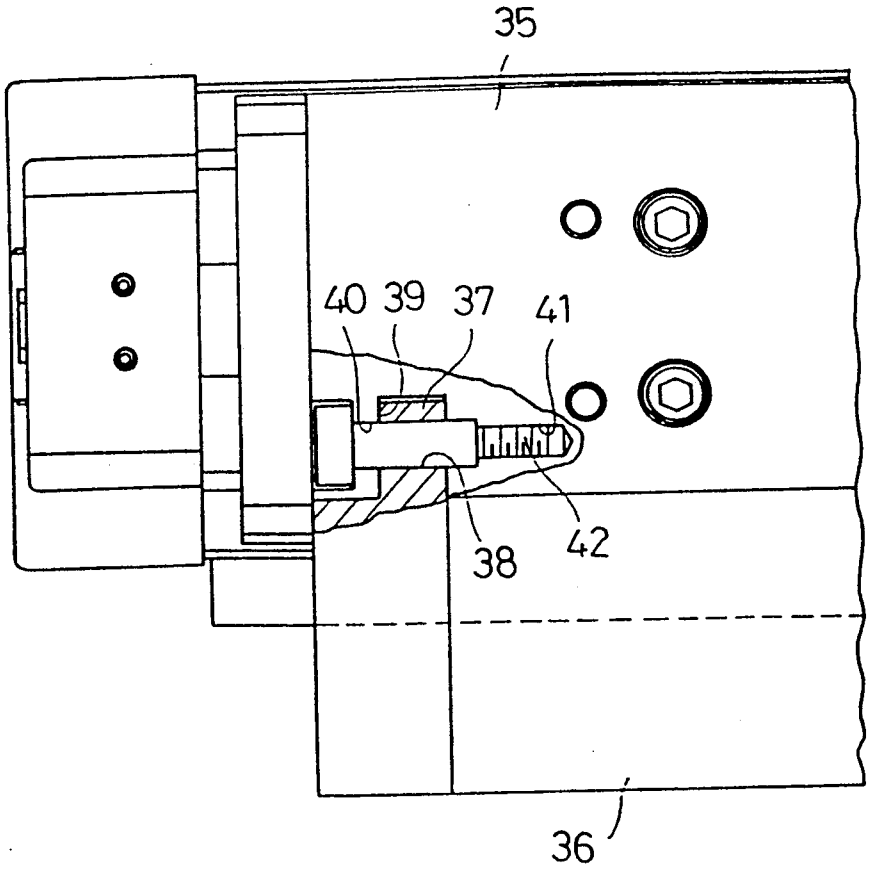
FIG. 11 is a partly cutaway plan view of FIG. 10.

As shown in FIG. 11, as the attachment arm 37 of the braking mechanism 36 is fitted tightly in the fitting recess 39 of the moving mechanism 35, the bore 40, the bore 38 and the threaded bore 41 are aligned. The braking mechanism 36 is undetachably attached to the moving mechanism 35, by driving a screw 42 into the threaded bore 41 via the bore 38, from the bore 40.

With the above structure, when the brake system fails, the braking mechanism 36 can be detached from the moving mechanism 35 for repair, for example, thus making the maintenance simpler.

Since the load applied on the table 3 is received by the piston 2, no load will be applied to the brake system. The brake system therefore has high durability.

Figure 12:
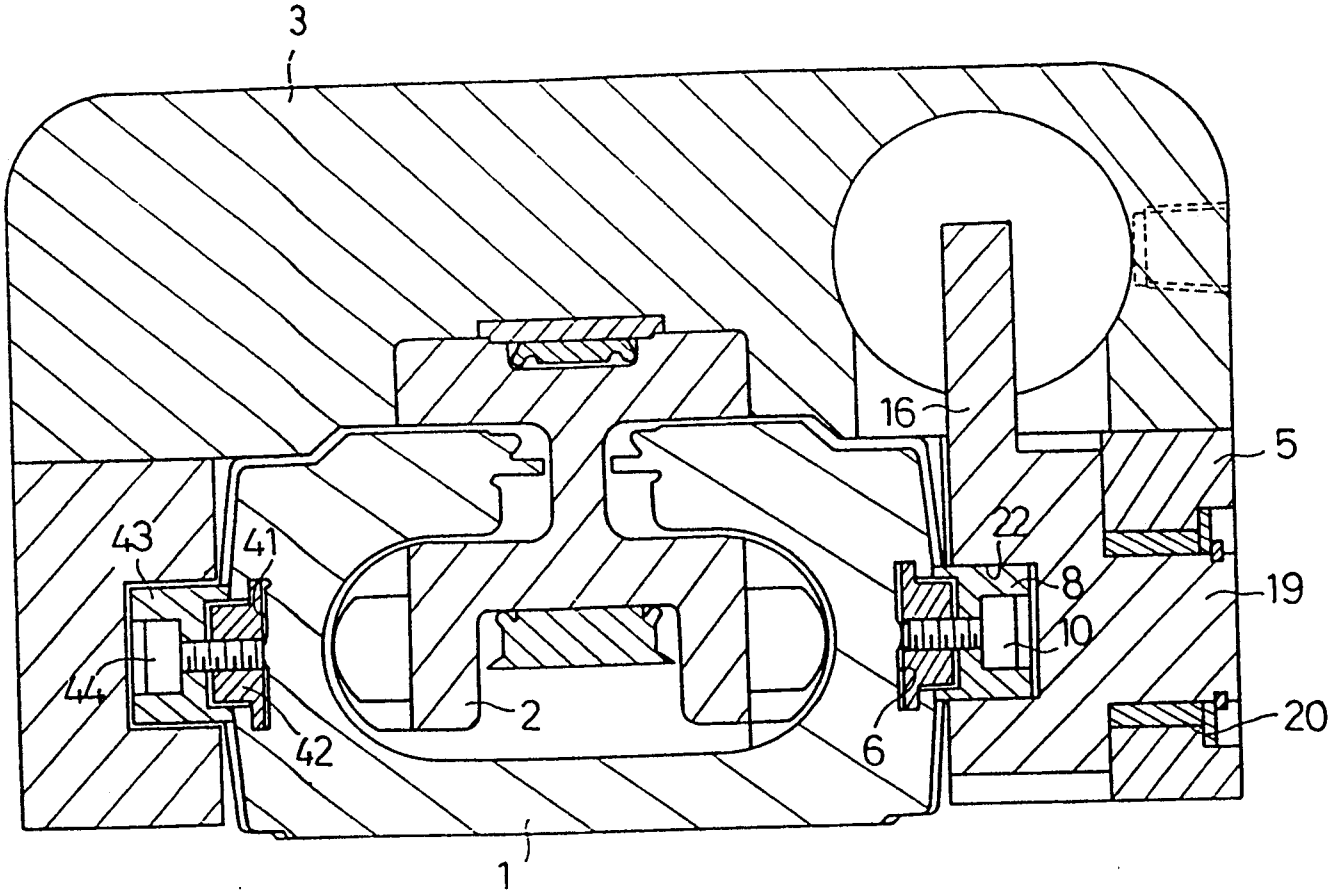
FIG. 12 is a cross-sectional front view showing a rod-less cylinder according to a fourth embodiment of the present invention.
Figure 13:
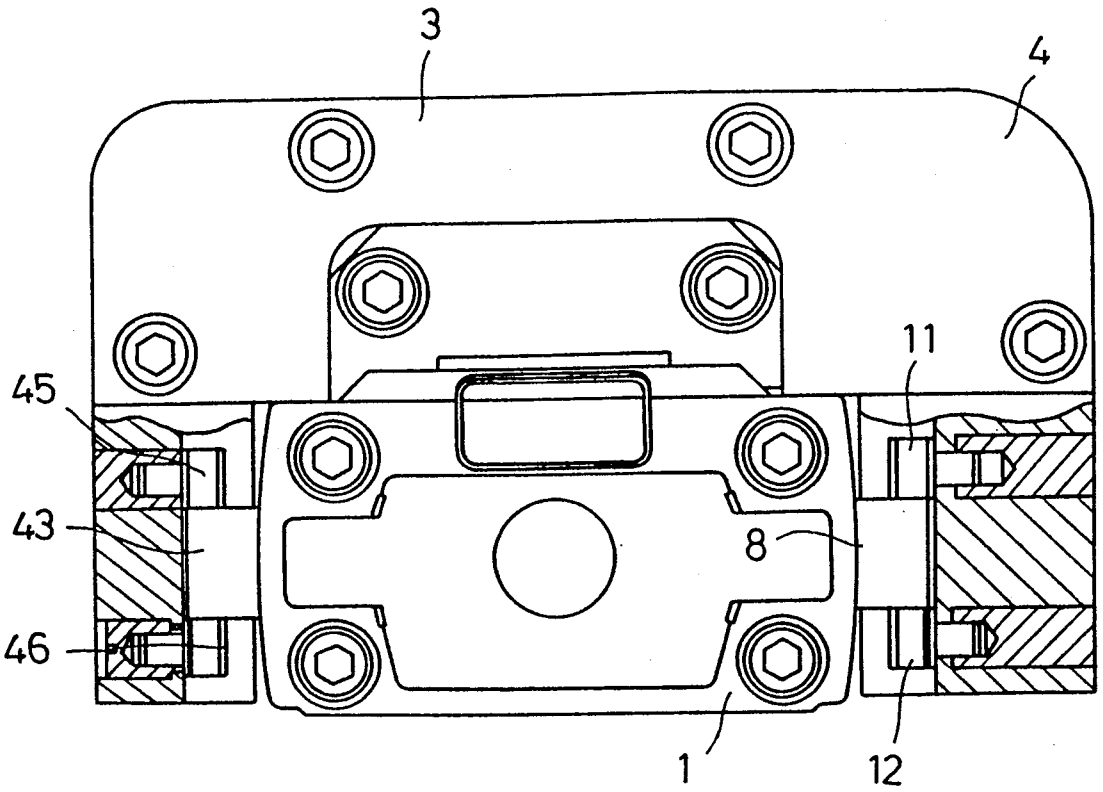
FIG. 13 is a partly cutaway cross-sectional front view illustrating first guide rollers of the rod-less cylinder shown in FIG. 12.
Figure 14:
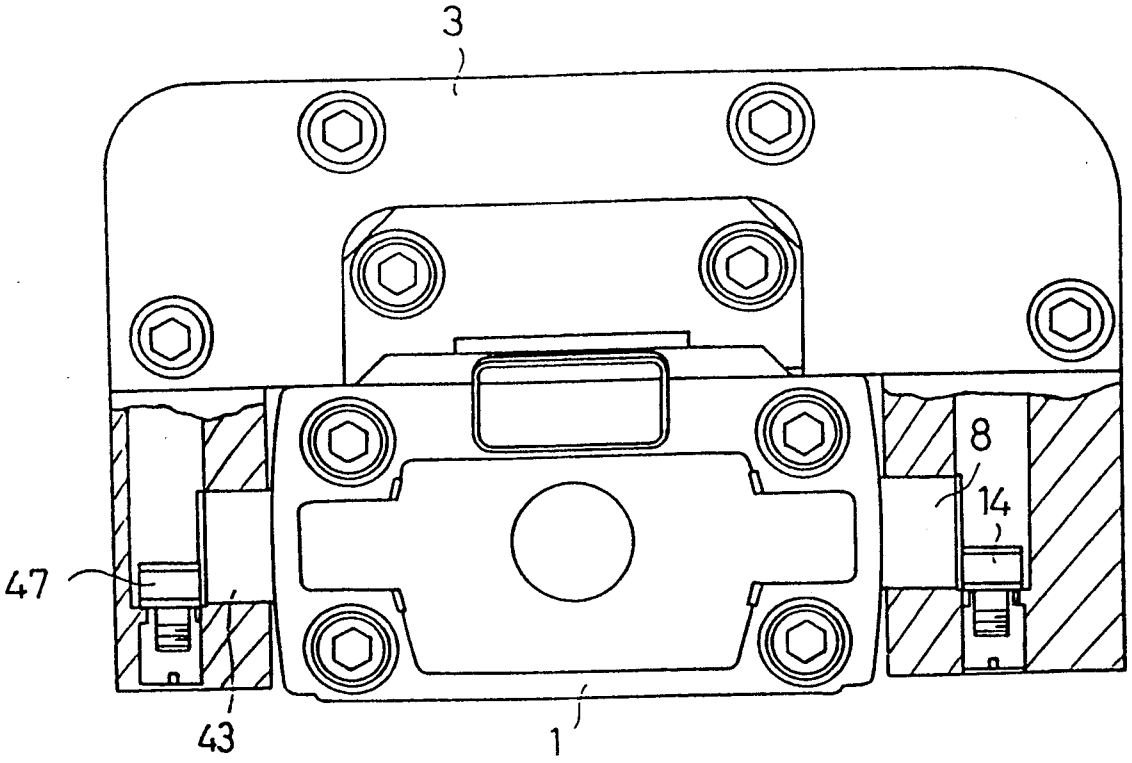
FIG. 14 is a partly cutaway cross-sectional front view illustrating a second guide roller of the rod-less cylinder shown in FIG. 12.

Referring now to FIGS. 12 through 14, a third embodiment of the present invention will be described.

In this embodiment, the table 3 is formed wider and the rail mechanism is designed to be symmetrical, as shown in FIG. 12. Internally threaded parts 42 are received in dovetail grooves 41 opposite to the dovetail grooves 6. A rail 43 is laid in association with the dovetail grooves 41. The rail 43 is secured to the outer side surface of the cylinder body 1 by a plurality of screws 44. First guide rollers 45 and 46, as shown in FIG. 13, and second guide rollers 47, as shown in FIG. 14, restrict the vertical and horizontal movements of the table 3, respectively. The guide shoe 31 is omitted in this structure.

As the rail 43 is thus provided in symmetry to the brake rail 8 so that the load applied to the table 3 is received by both rails 8 and 43, the structure becomes more rigid. This structure can therefore cope with a high load and high rigidity.

As the guide shoe 31 is omitted, there will be sufficient space.

The present invention is not limited to the structures of the above-described embodiments, but may be worked out by modifying the structures of the individual portions as desired, such as properly modifying the braking lever 16 or the operation device 17, without departing from the scope of this invention.

We claim:

1. A braking apparatus for a rod-less cylinder having a slidable piston in a cylinder body, the apparatus comprising:

a transfer body arranged outside the cylinder body, and coupled to the piston to be movable with the piston;

a brake rail laid along a moving direction of the piston, the brake rail having a pair of braking surfaces formed at its upper and lower portions and a fitting side surface facing the cylinder body, said brake rail being secured on the cylinder body in such a way that said fitting side surface contacts an outer side surface of the cylinder body over an entire length of said brake rail;

braking means provided in said transfer body, and having a pair of braking portions contactable to said braking surfaces in such a way as to sandwich said brake rail in line contact along a width direction of said brake rail, said braking means being selectively switched between a contact position where said braking portions are pressed against said brake rail and a release position where the forced abutment to the brake rail is released; and operation means for switching said braking means between the contact position and the release position to perform braking and unbraking on said transfer member.

2. The braking apparatus according to claim 1, wherein said braking portions of said braking means are arcuate braking surfaces protruding toward the brake rail.

3. The braking apparatus according to claim 1, wherein said braking means includes a braking lever switchably positioned between said contact position and said release position, and a pair of followers which intervene between said braking lever and the brake rail and which are pressed against or released from said brake rail in accordance with an operation of said braking lever.

4. The braking apparatus according to claim 3, wherein at least contact portions of said followers to said brake rail are made of a material that is softer than that of said brake rail.

5. The braking apparatus according to claim 3, wherein said braking lever includes a projection having an arcuate surface protruding toward said brake rail, to press said followers against said brake rail.

6. The braking apparatus according to any one of claims 1 to 3, wherein said operation means includes a spring, a first control piston for normally holding said braking means at said contact position by action of said spring, and a second control piston for switching said braking means to said release position from said contact position, by fluid pressure acting against the action of said spring.

7. The braking apparatus according to any one of claims 1 to 3, further comprising a pair of rollers for rotatably engaging the top and bottom surfaces of said brake rail, to restrict vertical movement of said transfer body.

8. The braking apparatus according to claim 7, further comprising a third roller for rotatably engaging a side surface of said brake rail, to restrict the horizontal movement of said transfer body.

9. The braking apparatus according to claim 1, wherein said braking means provided on said transfer body is separable from said transfer body.

10. The braking apparatus according to any one of claims 1 to 3, further comprising a guide rail provided on the outer side surface of the cylinder body, opposite to said brake rail.

11. The braking apparatus according to claim 10, further comprising a pair of rollers for rotatably engaging the top and bottom surfaces of said guide rail, to restrict the vertical movement of said transfer body.

12. The braking apparatus according to claim 11, further comprising a third roller for rotatably engaging a side surface of said guide rail, to restrict the horizontal movement of said transfer body.

* * * * *

UNITED STATES PATENT AND TRADEMARK OFFICE

CERTIFICATE OF CORRECTION

PATENT NO. : 5,293,812
DATED : March 15, 1994
INVENTOR(S) : Maki et al.

It is certified that error appears in the above-indentified patent and that said Letters Patent is hereby corrected as shown below:

On the cover page, at (22) PCT Filed:, please correct the International Filing Date as follows:

From "October 31, 1991" to

--October 30, 1991--

Signed and Sealed this

Thirteenth Day of September, 1994

*Attest:*

*Attesting Officer*

Bruce Lehman

BRUCE LEHMAN

*Commissioner of Patents and Trademarks*